United States Patent [19]

Asakura et al.

[11] Patent Number: 4,870,586

[45] Date of Patent: Sep. 26, 1989

[54] AIR-FUEL RATIO CONTROL SYSTEM FOR AN INTERNAL COMBUSTION ENGINE WITH AN ENGINE LOAD RESPONSIVE CORRECTION OPERATION

[75] Inventors: Masahiko Asakura, Tokorozawa; Takanori Shiina, Utsunomiya; Masahiro Ueda, Asaka; Shinichi Kubota, Nagareyama; Tomohiko Kawanabe, Utsunomiya; Noritaka Kushida, Tokyo; Minoru Muroya, Wako, all of Japan

[73] Assignee: Honda Giken Kogyo Kabushiki Kaisha, Tokyo, Japan

[21] Appl. No.: 202,862

[22] Filed: Jun. 6, 1988

Related U.S. Application Data

[63] Continuation of Ser. No. 820,032, Jan. 21, 1986, abandoned.

[30] Foreign Application Priority Data

Apr. 16, 1985 [JP] Japan ..... 60-081176
Apr. 16, 1985 [JP] Japan ..... 60-081177

[51] Int. Cl.[4] ..... F02M 23/06; F02D 41/26

[52] U.S. Cl. ..... 364/431.06; 123/440; 123/489; 364/431.07

[58] Field of Search ..... 364/424.1, 431.05, 431.06, 364/431.07; 123/440, 480, 489, 585; 74/857, 860, 866

[56] References Cited

U.S. PATENT DOCUMENTS

| | | | |
|---|---|---|---|
| 4,088,100 | 5/1978 | Tokura et al. | 123/440 |
| 4,169,441 | 10/1979 | Hirano et al. | 123/489 |
| 4,389,996 | 6/1983 | Yaegashi et al. | 123/585 |
| 4,401,073 | 8/1983 | Furuhashi | 74/860 |
| 4,561,403 | 12/1985 | Oyama et al. | 123/489 |
| 4,655,188 | 4/1987 | Tomisawa et al. | 123/489 |
| 4,694,803 | 9/1987 | Asakura et al. | 123/440 |
| 4,751,909 | 6/1988 | Otobe | 123/489 |

FOREIGN PATENT DOCUMENTS

| | | | |
|---|---|---|---|
| 0136519 | 4/1985 | European Pat. Off. . | |
| 2553696 | 6/1976 | Fed. Rep. of Germany . | |
| 0097945 | 6/1982 | Japan | 74/857 |
| 58-59330 | 4/1983 | Japan . | |
| 0187146 | 10/1984 | Japan | 74/857 |

*Primary Examiner*—Felix D. Gruber
*Attorney, Agent, or Firm*—Pollock, Vande Sande and Priddy

[57] ABSTRACT

An air-fuel ratio control system for an internal combustion engine mounted on a vehicle with a transmission, including an oxygen concentration sensor producing an output signal whose level is substantially proportional to an oxygen concentration of the exhaust gas, effects a feedback control of the air-fuel ratio of mixture to be supplied to the engine toward a target value determined on the basis of various parameters of the engine operation and corrected in response to a magnitude of atmospheric pressure, so that the higher a shift position of the transmission gear is, the leaner the target air-fuel ratio becomes. Thus, the fuel consumption in a light load operating condition of the engine is decreased and the driveability of the vehicle is improved.

3 Claims, 10 Drawing Sheets

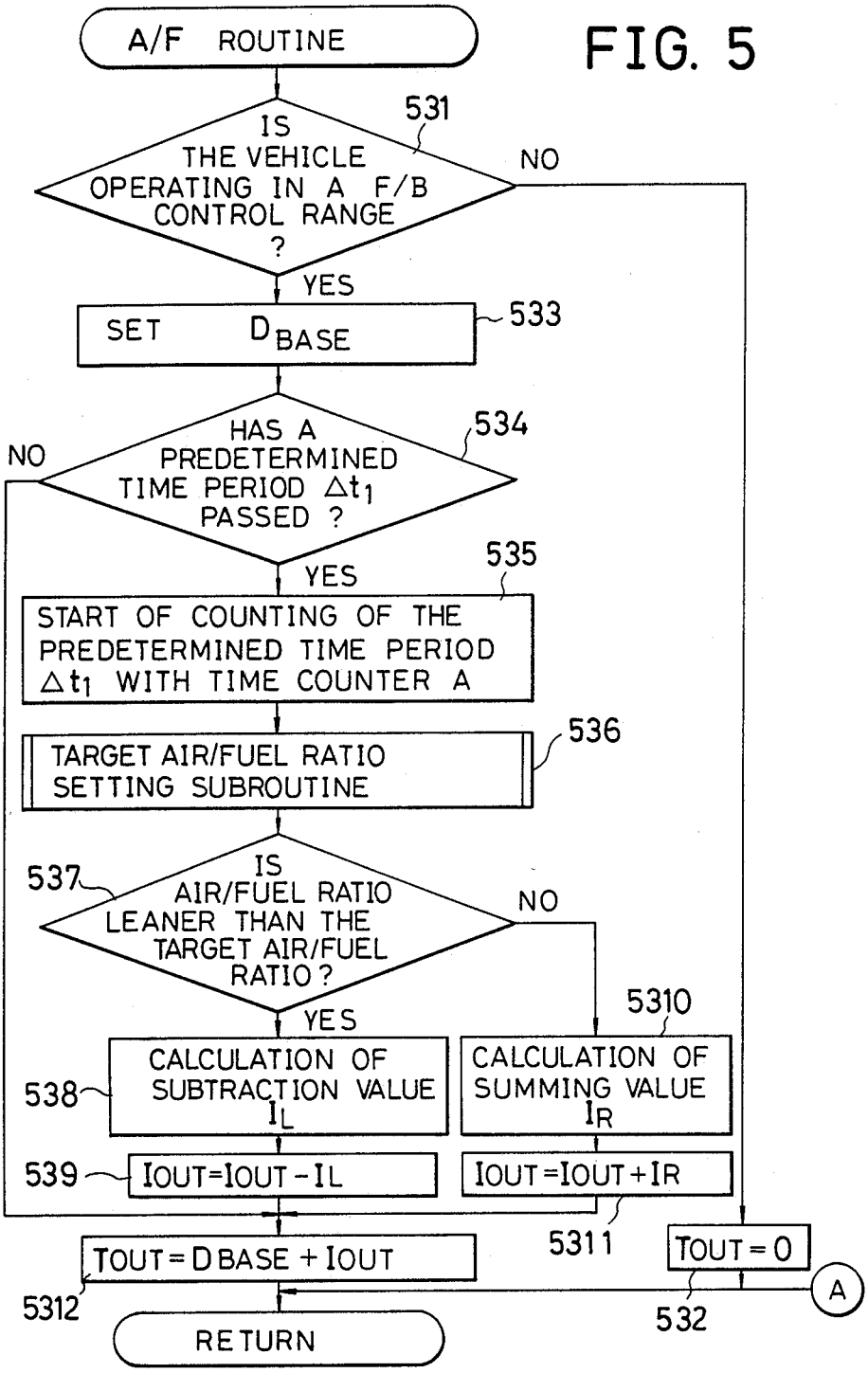
A/F ROUTINE
FIG. 5
IS THE VEHICLE OPERATING IN A F/B CONTROL RANGE ?
531
NO
YES
SET $D_{BASE}$
533
HAS A PREDETERMINED TIME PERIOD $\Delta t_1$ PASSED ?
534
NO
YES
535
START OF COUNTING OF THE PREDETERMINED TIME PERIOD $\Delta t_1$ WITH TIME COUNTER A
TARGET AIR/FUEL RATIO SETTING SUBROUTINE
536
IS AIR/FUEL RATIO LEANER THAN THE TARGET AIR/FUEL RATIO ?
537
NO
YES
5310
CALCULATION OF SUBTRACTION VALUE $I_L$
538
CALCULATION OF SUMMING VALUE $I_R$
539
IOUT=IOUT-IL
IOUT=IOUT+IR
5311
TOUT=DBASE+IOUT
5312
TOUT=0
532
A
RETURN

AIR-FUEL RATIO CONTROL SYSTEM FOR AN INTERNAL COMBUSTION ENGINE WITH AN ENGINE LOAD RESPONSIVE CORRECTION OPERATION

This appliction is a continuation of Ser. No. 820,032, filed on Jan. 21, 1986 and now abandoned.

BACKGROUND OF THE INVENTION

1. Field of the Invention

The present invention relates to an air-fuel ratio control system for an internal combustion engine, and more particularly a system in which the air-fuel ratio of the mixture to be supplied to the engine is controlled toward a target value in response to an output signal level of an oxygen concentration sensor.

2. Description of Background Information

Air-fuel ratio feedback control systems for an internal combustion engine are known wherein the oxygen concentration in the exhaust gas of the engine is detected by an oxygen concentration sensor (referred to as $O_2$ sensor hereinafter) and the air-fuel ratio of the mixture to be supplied to the engine is feedback controlled in response to an output signal level of the $O_2$ sensor for the purification of the exhaust gas and improvements of the fuel economy. As an example of such an air-fuel ratio feedback control system, an air-intake side secondary air supply system for the feedback control is proposed, for example, in Japanese Patent Publication No. 55-3533 in which an open/close valve is disposed in an air intake side secondary air supply passage leading to a carburetor of the engine and a duty ratio of the open and close of the open/close valve, i.e. the supply of the air intake side secondary air, is feedback controlled in response to the output signal level of the $O_2$ sensor.

In the usual air-fuel ratio feedback control systems, it is customary to use an $O_2$ sensor whose output signal level is not proportional to the oxygen concentration in the exhaust gas. On the other hand, an $O_2$ sensor has been developed recently whose output signal level varies generally in proportion to the oxygen concentration in the exhaust gas when the air-fuel ratio of the mixture to be supplied to the engine is leaner than a stoichiometric air-fuel ratio. For instance, an air-fuel ratio control system using an $O_2$ sensor of this type for precisely controlling the air-fuel ratio toward a target air-fuel ratio in a lean air-fuel ratio is described in Japanese patent application laid open No. 58-59330.

In the air-fuel ratio feedback control system in which the air-fuel ratio is controlled by a feedback operation toward a target air-fuel ratio using such a "lean $O_2$ sensor", the target air-fuel ratio is usually determined from a pressure within the intake pipe on the down stream side of the throttle valve, and the engine speed. However, with this type of air-fuel ratio feedback control system, the target air-fuel ratio was generally determined without considering load conditions of the vehicle. Therefore, the reduction of the fuel consumption of the engine under a running condition was not sufficient even with the control operation of the air-fuel ratio toward the target air-fuel ratio especially in an operational range of the vehicle in which the engine load is relatively light.

Further, when the change in the engine load occurs due to a down shift operation or an up shift operation of the transmission, the air-fuel ratio of the mixture to be supplied to the engine will deviate from the target air-fuel ratio. However, under such a condition, a delay of the air-fuel ratio control has been experienced in conventional systems because of a time period required for detecting the deviation of the air-fuel ratio of the mixture as a change in the oxygen concentration in the exhaust gas by means of the $O_2$ sensor. This has been causing deterioration of the driveability of the vehicle.

SUMMARY OF THE INVENTION

An object of the present invention is to provide an air-fuel ratio control system for an internal combustion engine, by which the fuel consumption of the engine under a running condition of the vehicle is sufficiently reduced.

Another object of the present invention is to provide an air-fuel ratio control system for an internal combustion engine in which measures are taken to improve the driveability of the vehicle at a time of load change.

According to the present invention, an air-fuel ratio control system for an internal combustion engine is operated to correct a target air-fuel ratio in accordance with the shift position of the transmission, and a feedback control of the air-fuel ratio of the mixture toward a corrected value of the target air-fuel ratio is effected.

According to another aspect of the present invention, an air-fuel ratio control system for an internal combustion engine performs operations of detecting whether an air-fuel ratio of the mixture is leaner or richer with respect to a target air-fuel ratio by means of an output signal level of the $O_2$ sensor, determining a base valve open period of the open/close valve in response to a plurality of engine operational parameters every predetermined period, correcting the base valve open period at least in accordance with a result of detection of the air-fuel ratio and a shift position of the transmission to provide an output valve open period within each cyclic period, and opening the open/close valve during the output valve open period for each cyclic period.

BRIEF DESCRIPTION OF THE DRAWINGS

FIGS. 4 through 6 are flowcharts showing the manner of operation of a CPU 29 in the control circuit 20 in a first embodiment of the air-fuel ratio control system according to the present invention, in which FIG. 4 shows a main routine, FIG. 5 shows an A/F routine, and FIG. 6 shows a target air-fuel ratio setting subroutine respectively;

FIGS. 11 and 12 are flowcharts showing the manner of operation of the CPU 29 in the second embodiment of the air-fuel rato control system according to the present invention, in which FIG. 11 shows the A/F routine, and FIG. 12 shows the base valve open period calculation subroutine.

DETAILED DESCRIPTION OF THE PREFERRED EMBODIMENTS

Referring to FIGS. 1 through 8 of the accompanying drawings, the first embodiment of the air intake side secondary air supply system according to the present invention will be explained hereinafter.

Figure 1:
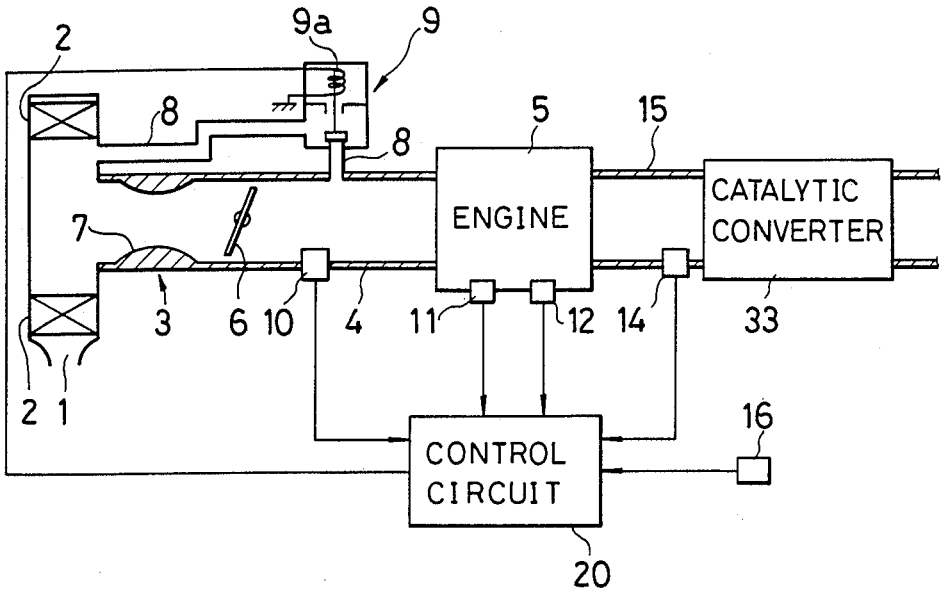
FIG. 1 is a schematic diagram showing the general construction of a system according to the invention.

In FIG. 1 which illustrates the general construction of the air intake side secondary air supply system, intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. The inside of the air cleaner 2, near an air outlet port, communicates with the intake manifold 4 via an air intake side secondary air supply passage 8. The air intake side secondary air supply passage 8 is provided with an open/close solenoid valve 9. The open/close solenoid valve 9 is designed to open when a drive current is supplied to a solenoid 9*a* thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and a lean $O_2$ sensor 14 which is provided in an exhaust manifold 15 of the engine for generating an output signal whose level varies in proportion to the oxygen concentration in the exhaust gas.

Figure 2:
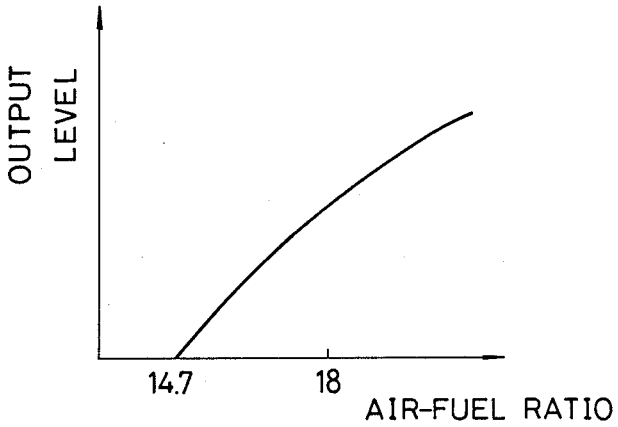
FIG. 2 is a diagram showing a signal output characteristic of the $O_2$ sensor 14 used in the system of FIG. 1.

FIG. 2 shows a signal output characteristic of the $O_2$ sensor 14. As shown, the output signal level of the $O_2$ sensor increases proportionally as the oxygen concentration in the exhaust gas becomes leaner from a stoichiometric air-fuel ratio (14.7). Further, a catalytic converter 33 for accelerating the reduction of the noxious components in the exhaust gas is provided in the exhaust manifold 15 at a location on the downstream side of the position of the $O_2$ sensor 14. The open/close solenoid valve 9, the absolute pressure sensor 10, the crank angle sensor 11, the engine cooling water temperature sensor 12, and the $O_2$ sensor 14 are electrically connected to a control circuit 20. Further, a vehicle speed sensor 16 which produces an output signal whose level is proportional to the speed of the vehicle is electrically connected to the control circuit 20.

Figure 3:
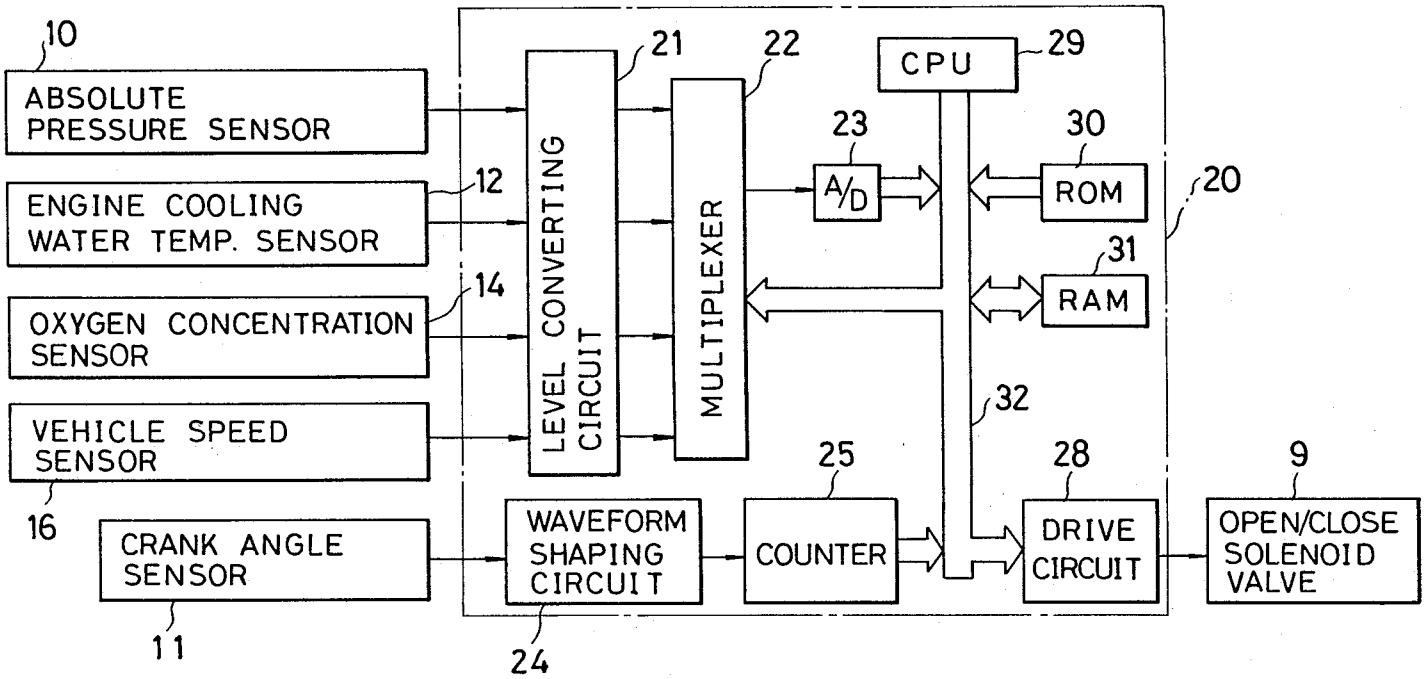
FIG. 3 is a block diagram showing the construction of the control circuit 20 of the system of FIG. 1.

FIG. 3 shows the construction of the control circuit 20. As shown, the control circuit 20 includes a level converting circuit 21 which effects a level conversion of the output signals of the absolute pressure sensor 10, the engine cooling water temperature sensor 12, the $O_2$ sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the open/close solenoid valve 9 in an opening direction, a CPU (central processing unit) 29 which performs digital operations according to various programs, a ROM 30 in which various operating programs and data are previously stored, and a RAM 31. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also information indicative of the engine speed from the counter 25 is supplied to the CPU 29 via the input/output bus 32. The CPU 29 is constructed to generate an internal interruption signal every duty cycle $T_{SOL}$ (100 m sec, for instance). In response to this internal interruption signal, the CPU 29 performs an operation for the duty ratio control of the air intake side secondary air supply, explained hereinafter.

Figure 4:
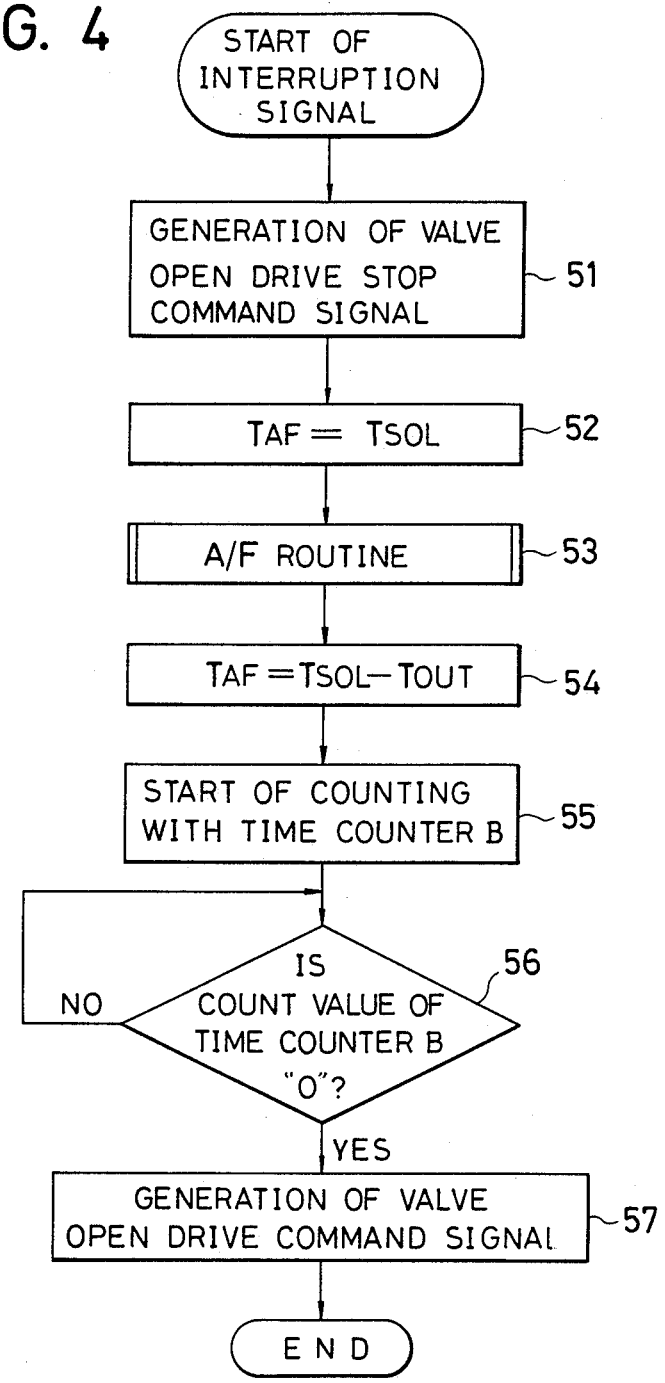
Figure 6:
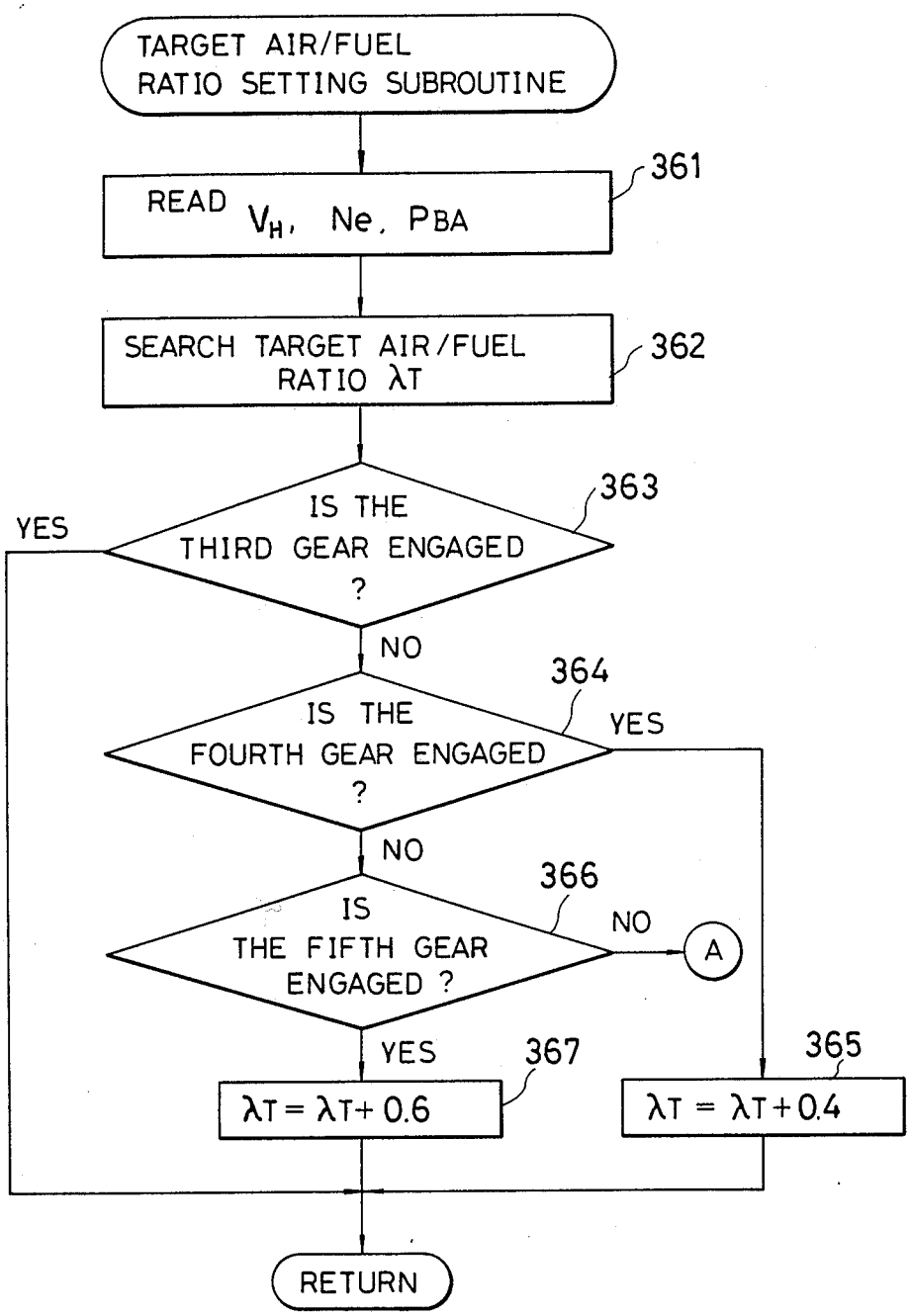

Referring to the flowcharts of FIG. 4 through FIG. 6, the operation of the air-fuel ratio control system according to the present invention will be explained hereinafter.

At a step 51, a valve open drive stop command signal is generated in the CPU 29 and supplied to the drive circuit 28, at every time of the generation of the internal interruption signal in the CPU 29. With this signal, the drive circuit 28 is controlled to close the open/close solenoid valve 9. This operation is provided so as to prevent malfunctions of the open/close solenoid valve 9 during the calculating operation of the CPU 29. Next, a valve close period $T_{AF}$ of the open/close solenoid valve 9 is made equal to a period of one duty cycle $T_{SOL}$ at a step 52, and an A/F routine for calculating a valve open period $T_{OUT}$ of the open/close solenoid valve 9 which is shown in FIG. 5 is carried out through steps generally indicated at 53.

Figure 7:
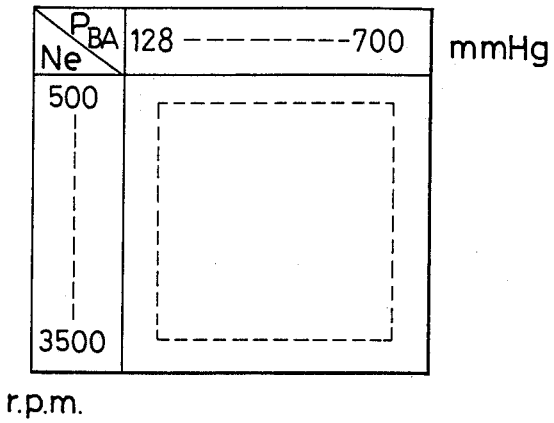
FIG. 7 is a diagram showing a data map which is previously stored in a ROM 30 of the control circuit 20.

In the A/F routine, whether or not the operating state of the vehicle (including operating states of the engine) satisfies a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the open/close solenoid valve 9 is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 7, and the CPU 29 firstly reads current values of the absolute pressure $P_{BA}$ and the engine speed $N_e$ and in turn searches a value of the period of base duty ratio $D_{BASE}$ corresponding to the read values from the $D_{BASE}$ date map in the ROM 30. Then, whether or not a count period of a time counter A incorporated in the CPU 29 (not shown) has reached a predetermined time period $\Delta t_1$ is detected at a step 534. This predetermined time period $\Delta t_1$ corresponds to a delay time from a time of the supply of the air intake side secondary air to a time in which a result of the supply of the air intake side secondary air is detected by the $O_2$ sensor 14 as a change in the oxygen concentration of the exhaust gas. When the predetermined time period $\Delta t_1$ has passed after the time counter A is reset to start the counting of time, the counter is reset again, at a step 535, to start the counting of time from a predetermined initial value. In other words, a detection as to whether or not the predetermined time period $\Delta t_1$ has passed after the start of the counting of time from the initial value by the time counter A, i.e. the execution of the step 535, is performed at the step 534. After the start of the counting of the predetermined time period $\Delta t_1$ by the time counter A in this way, a target air-fuel ratio setting subroutine shown in FIG. 6 for setting a target air-fuel ratio is executed through steps generally indicated at 536.

In the target air-fuel ratio setting subroutine in this embodiment, current values of the engine speed $N_e$, vehicle speed $V_H$ and the absolute pressure $P_{BA}$ are read at a step 361. Then a value of the target air-fuel ratio $\lambda_T$ is searched from the A/F data map prepared in the ROM 30 at a step 362. In the ROM 30, various values for the target air-fuel ratio $\lambda_T$ which are determined according to the values of the absolute pressure within the intake manifold $P_{BA}$ and the engine speed $N_e$ as in the case of the $D_{BASE}$ data map, are previously stored as an A/F data map separately from the $D_{BASE}$ data map. After the searching of the target air-fuel ratio, whether or not the third gear of the five speed transmission is engaged is detected at a step 363. If the third gear is engaged, the searched value of the target air-fuel ratio is maintained. If the third gear is not engaged, whether or not the fourth gear is engaged is detected at a step 364. If the fourth gear is engaged, a value 0.4 is added to the searched target air-fuel ratio and a result of calculation is set as a new target air-fuel ratio at a step 365. If the fourth gear is not engaged, whether or not the fifth gear is engaged is in turn detected at a step 366. If the fifth gear is engaged, a value 0.6 is added to the searched value of the target air-fuel ratio and a result of the calculation is set as a new value of the target air-fuel ratio at a step 367. If the fifth gear is not engaged, it means that the shift position is any one of the first, second and neutral positions and the CPU 29 determines that the A/F routine has completed and returns to the execution of the main routine. In the above steps, the shift position is detected by means of the vehicle speed $V_H$ and the engine speed $N_e$ because regions of a ratio between the vehicle speed $V_H$ and the engine speed $N_e$ different from each other are obtained for the first to fifth gear of the transmission.

After the setting of the target air-fuel ratio $\lambda_T$ in this way, whether or not the air-fuel ratio of the mixture which is detected from the information of the oxygen concentration in the exhaust gas is leaner than the target air-fuel ratio $\lambda_T$ is detected at a step 537. This detection is performed such that an oxygen concentration level $LO_2$ (output signal level of the $O_2$ sensor) is compared with a level $L_\lambda$ corresponding to the target air-fuel ratio $\lambda_T$. If it is detected at the step 537 that the air-fuel ratio of the mixture is leaner than the target air-fuel ratio, a subtraction value $I_L$ is calculated at a step 538. The subtraction value $I_L$ is obtained by multiplication among a constant $K_1$, the engine speed $N_e$, and the absolute pressure $P_{BA}$, ($K_1 \cdot N_e \cdot P_{BA}$), and is dependent on the amount of the intake air of the engine 5. After the calculation of the subtraction value $I_L$, a correction value $I_{OUT}$ which is previously calculated by the execution of operations of the A/F routine is read out from a memory location $a_1$ in the RAM 31. Subsequently, the subtraction value $I_L$ is subtracted from the correction value $I_{OUT}$, and the result is written in the memory location al of the RAM 31 as a new correction value $I_{OUT}$, at a step 539. On the other hand, if it is detected that the air-fuel ratio is richer than the target air-fuel ratio at the step 537, a summing value $I_R$ is calculated at a step 5310. The summing value $I_R$ is calculated by a multiplication among a constant value $K_2$ ($\neq K_1$), the engine speed $N_e$, and the absolute pressure $P_{BA}$ ($K_2 \cdot N_e \cdot P_{BA}$), and is dependent on the amount of the intake air of the engine 5. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. The result of the summation is in turn stored in the memory location $a_1$ of the RAM 31 as a new correction value $I_{OUT}$ at a step 5311. After the calculation of the correction value $I_{OUT}$ at the step 539 or the step 5311 in this way, the correction value $I_{OUT}$ and the period of base duty ratio $D_{BASE}$ set at the step 533 are added together, and the result of this addition is used as the valve open period $T_{OUT}$ at a step 5312.

Additionally, after the reset of the time counter A and the start of the counting from the initial value at the step 535, if it is detected that the predetermined time period $\Delta t_1$ has not yet passed at the step 534, the operation of the step 5312 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$ at a step 54. Subsequently, a value corresponding to the valve close period $T_{AF}$ is set in a time counter B incorporated in the CPU 29 (not shown), and down counting of the time counter B is started at a step 55. Then whether or not the count value of the time counter B has reached a value "0" is detected at a step 56. If the count value of the time counter B has reached the value "0", a valve open drive command signal is supplied to the drive circuit 28 at a step 57. In accordance with this valve open drive command signal, the drive circuit 28 operates to open the open/close solenoid valve 9. The opening of the open/close solenoid valve 9 is continued until a time at which the operation of the step 51 is performed again. If, at the step 56, the count value of the time counter B has not reached the value "0", the step 56 is effected repeatedly.

Figure 8:
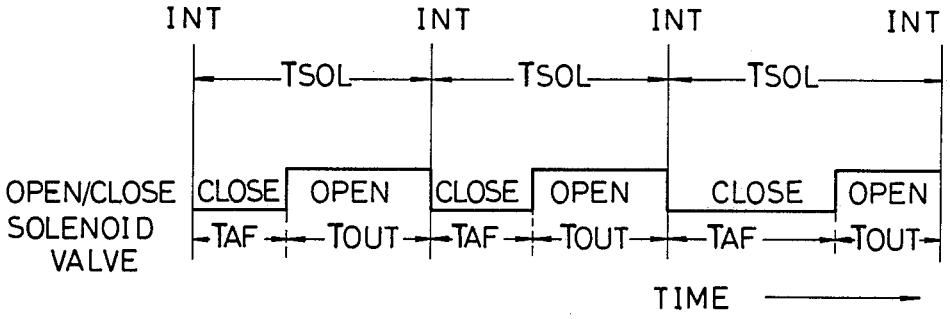
FIG. 8 is a timing chart showing the manner of operation of the system according to the invention generally shown in FIG. 1.

Thus, in the air intake side secondary air supply system according to the present invention, the open/close solenoid valve 9 is closed immediately in response to the generation of the internal interruption signal INT as illustrated in FIG. 8, to stop the supply of the air intake side secondary air to the engine 5. When the valve close time $T_{AF}$ for the open/close solenoid valve 9 within the period of one duty cycle is calculated and the valve close time $T_{AF}$ has passed after the generation of the interruption signal, the open/close solenoid valve 9 is opened to supply the air intake side secondary air to the engine through the air intake side secondary air supply passage 8. Thus, the duty ratio control of the supply of the air intake side secondary air is performed by repeatedly executing these operations. Further, the air-fuel ratio of the mixture to be supplied to the engine 5 is controlled to the target air fuel ratio by a duty ratio control of the supply of the air intake side secondary air. Through these operations, the accuracy of the air-fuel ratio control and the response characteristic of the control system with respect to the air intake side secondary air supply command are improved. Moreover, the delay of response of the control operation due to the change in the operational state of the engine are compensated for by setting the period of base duty ratio $D_{BASE}$ in accordance with the operating condition of the engine.

In the above explained embodiment, the air-fuel ratio control system was in the form of an air intake side secondary air supply system. However, it is be noted that the application of the present invention is not limited to this, and for instance, the present invention is applicable to a system in which the amount of fuel to be supplied to the engine is controlled.

In summary, in the air-fuel ratio control system according to the present invention, the target air-fuel ratio determined according to predetermined engine parameters is corrected in response to the shift position of the transmission. Therefore, the target air-fuel ratio is corrected so that it is suited for the state of the engine load under various running conditions of the vehicle. In other words, an improvement of the fuel consumption is enabled especially in the low load range of the engine operation by correcting the target air-fuel ratio toward the lean side so that the correction amount becomes greater for higher gear positions, since the engine load is lower in a higher gear position than that in a lower gear position.

Referring to FIGS. 9 through 13, the second embodiment of the air-fuel ratio control system according to the present invention will be explained hereinafter.

Figure 9:
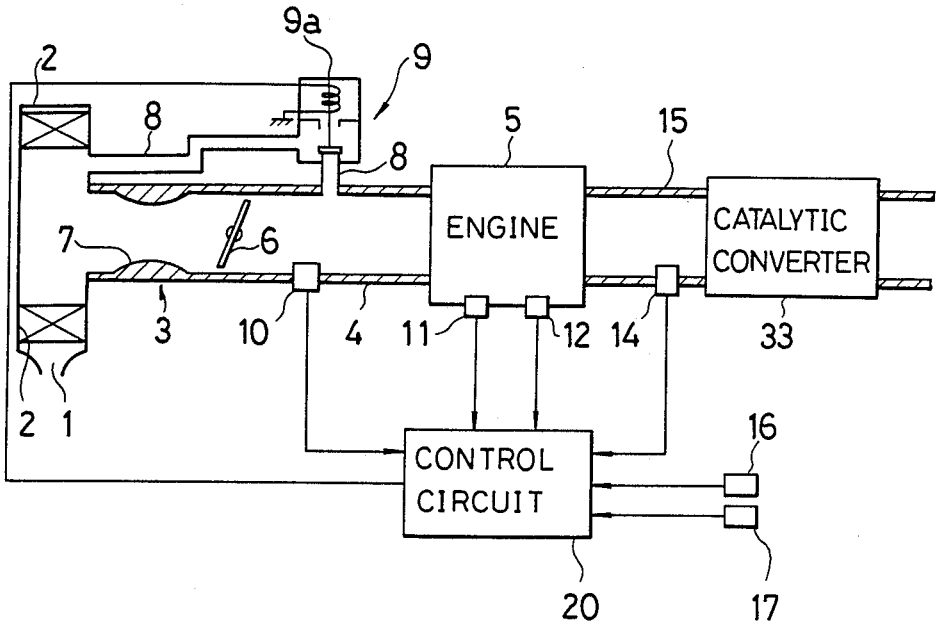
FIG. 9 is a schematic diagram showing the general construction of a second embodiment of the air-fuel ratio control system according to the present invention.
Figure 10:
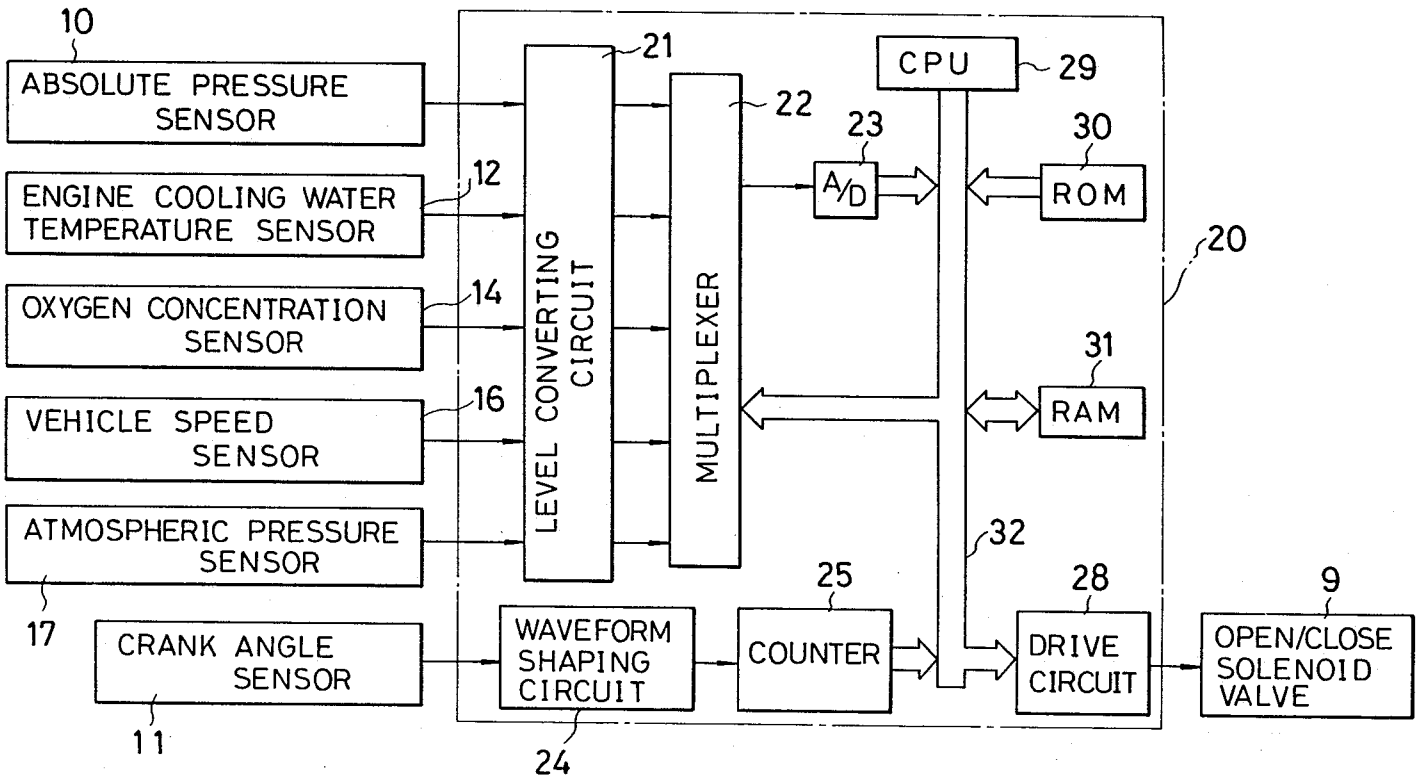
FIG. 10 is a block diagram showing the construction of the control circuit in the second embodiment generally shown in FIG. 9.

FIG. 9 shows the general construction of the second embodiment of the air-fuel ratio control system according to the present invention. As shown, the second embodiment has a construction which is basically identical with the previous embodiment. The only difference in the construction is that an atmospheric pressure sensor 17 is provided whose output signal is supplied to the control circuit 20. In the control circuit 20, as shown in FIG. 10, the output signal of the atmospheric pressure sensor 17 is supplied to the level converting circuit 21 together with the output signals of the sensors 10, 12, 14 and 16.

Since the operations of the second embodiment of the air-fuel ratio control system except for the A/F routine are the same as those of the first embodiment, the explanation thereof will not be repeated.

Figure 11:
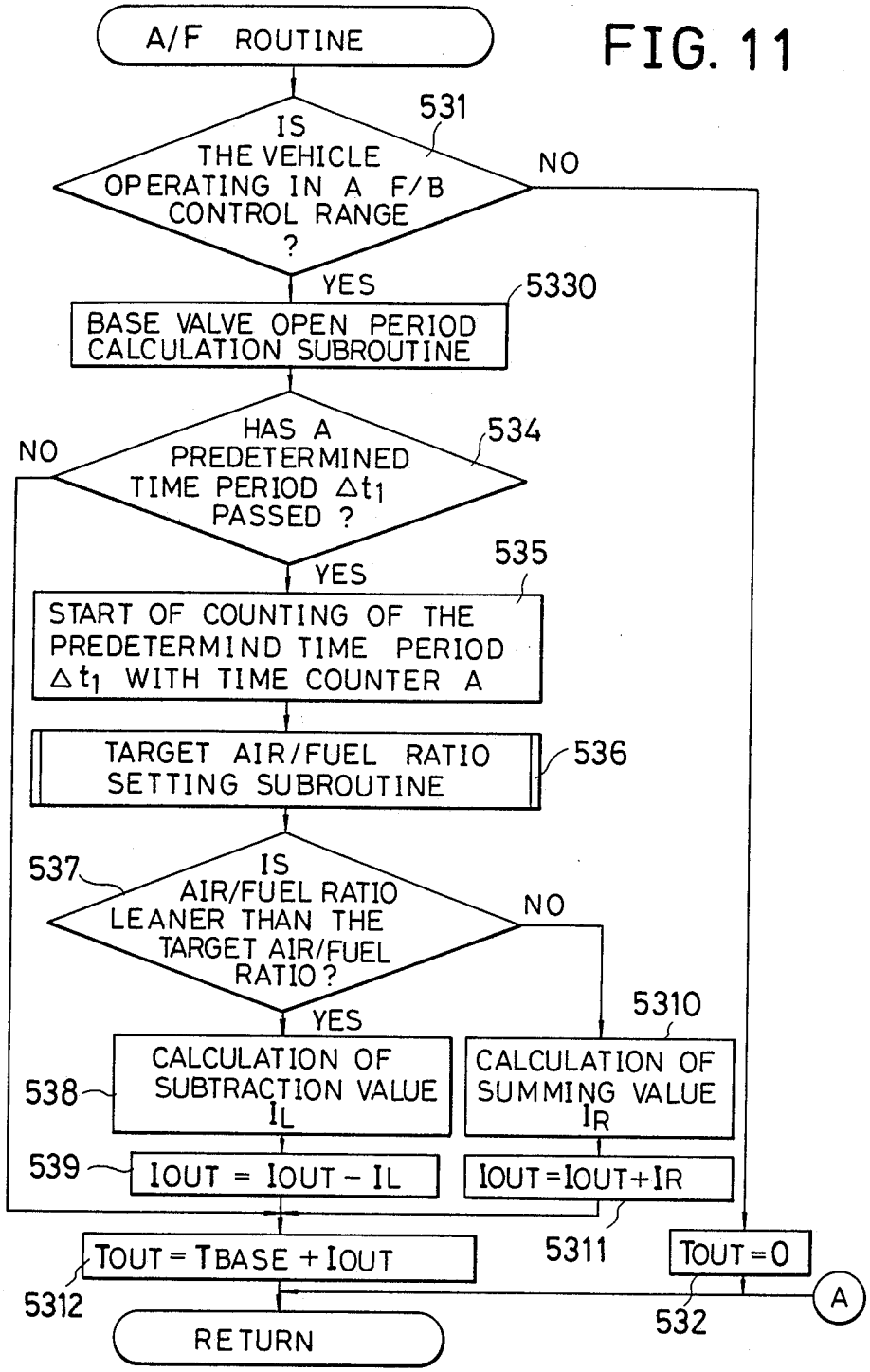

FIG. 11 shows the detail of the A/F routine of the second embodiment. In the A/F routine of this embodiment, whether or not operating states of the vehicle (including operating states of the engine) satisfy a condition for the feedback (F/B) control is detected at the step 531 in the same manner as the previous embodiment. Specifically this detection is performed according to various parameters, i.e., absolute pressure within the intake manifold, engine cooling water temperature, vehicle speed, and engine rotational speed. When the vehicle speed is low, when the engine cooling water temperature is low, or when the shift position of the transmission gear is in the first, second or the neutral position, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. The operation of the system up to this step is the same as the previous embodiment. On the other hand, if it is determined that the condition for the feedback control is satisfied, a $T_{BASE}$ calculation routine for calculating a base valve open period $T_{BASE}$ for the opening of the open/close solenoid valve 9 within the period of one duty cycle $T_{SOL}$ is executed through steps generally indicated at 5330.

Figure 12:
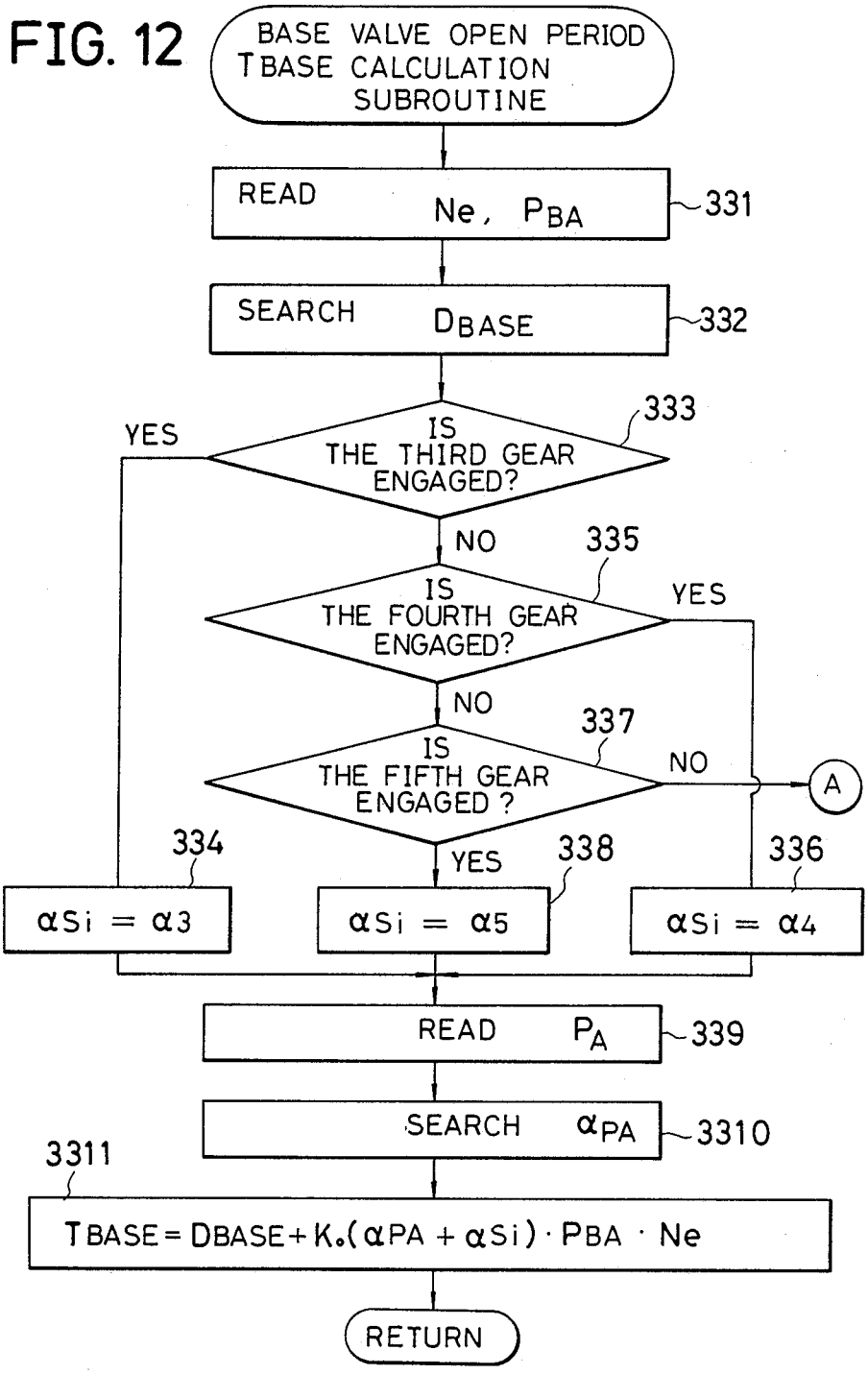

As shown in FIG. 12, in the $T_{BASE}$ calculation routine, current values of the engine speed $N_e$ and the absolute pressure within the intake manifold $P_{BA}$ are read at a step 331. Various values for a period of base duty ratio $D_{BASE}$ which are determined according to the absolute pressure $P_{BA}$ and the engine speed $N_e$ are previously stored in the ROM 30 in the form of a $D_{BASE}$ data map as shown in FIG. 7. Therefore, the CPU 29 firstly reads the current values of the absolute pressure $P_{BA}$ and the engine speed $N_e$ and in turn searches a value of the period of base duty ratio $D_{BASE}$ corresponding to the read values from the $D_{BASE}$ data map in the ROM 30. After the period of base duty ratio $D_{BASE}$ has been searched, whether or not the five speed transmission of the vehicle is shifted at the third gear, in other words, whether or not the third gear is engaged is detected at a step 333. If the third gear is engaged, a shift position correction coefficient $\alpha_{si}$ is made equal to a predetermined value $\alpha_3$ (18 μs for example) at a step 334. If the shift position is not the third gear, whether or not the fourth gear is engaged is detected at a step 335. If the fourth gear is engaged, the shift position correction coefficient $\alpha_{si}$ is made equal to a predetermined value $\Delta_4$ (38 μs for example) which is larger than the value $\alpha_3$ at a step 336. If the fourth gear is not engaged, whether or not the fifth gear is engaged is detected at a step 337. If the fifth gear is engaged, the shift position correction coefficient $\Delta_{si}$ is made equal to a predetermined value $\alpha_5$ (58 μs for example) which is larger than the value $\alpha_4$ at a step 338. If the fifth gear is not engaged, it means that the shift position is any one of the first gear, second gear, and the neutral position. Therefore, the CPU 29 determines that the operation of the A/F routine is finished, and returns to the execution of the main routine. After the set of the shift position correction coefficient $\alpha_{si}$, a current value of the atmospheric pressure $P_A$ is read at a step 339. Then an atmospheric pressure correction coefficient $\alpha_{PA}$ which is determined according to the atmospheric pressure value PA read at the step 339 is searched from an $\alpha_{PA}$ data map at a step 3310. In the ROM 30, various values for the atmospheric pressure correction coefficient $\alpha_{PA}$ determined from the atmospheric pressure $P_A$ are stored as the $\alpha_{PA}$ data map separately from the $D_{BASE}$ data map. The values for the atmospheric pressure correction coefficient $\alpha_{PA}$ are set such that it becomes large as the atmospheric pressure reduces. Then the base valve open period $T_{BASE}$ is calculated by an equation $T_{BASE}=D_{BASE}+K_0(\alpha_{PA}+\alpha_{si})\cdot P_{BA}\cdot N_e$, where $K_0$ is a constant, at a step 3311.

In addition, the detection at the step 337 can be omitted since, as in the case of the step 366, the step 531 will detect that the condition for the feedback control is not satisfied if the shift position is in any one of the first, second and the neutral position.

After the calculation of the base valve open period $T_{BASE}$ is this way, the operation through steps 534 and 535, i.e., the detection of the elapse of the predetermined period $\Delta t_1$, is performed in the same way as the previous embodiment. When the count of the predetermined time period $\Delta t_1$ by means of the counter A is started, the system executes the target air-fuel ratio setting subroutine which is generally indicated at 536.

After the setting of the target air-fuel ratio in this way, the remaining steps of the A/F routine, i.e., the steps 537 through 5312 are executed in the same manner as in the previous embodiment. Further, after the execution of the A/F routine, the control of the open/close valve, i.e., the steps 54 through 57 are executed in the same manner as the previous embodiment.

In summary, the shift position correction coefficient $\Delta_{si}$ is determined to be larger for a higher gear position than that for a lower gear position. Thus, the air-fuel ratio is made leaner for the higher gear position, with the prolonged base valve open period $T_{BASE}$. In addition, the air-fuel ratio is also made leaner when the altitude of the area in which the vehicle is running becomes higher, by means of an increase in the atmospheric pressure correction coefficient $\Delta_{PA}$, which extends the base valve open period $T_{BASE}$.

It will be appreciated from the foregoing, with the air-fuel ratio control system according to the present invention, the output valve open period is determined by correcting the base valve open period at least in response to the shift position of the transmission gear and the result of the detection of the air-fuel ratio by means of an output signal level of the $O_2$ sensor. The open/close valve is opened only during the output valve open period. Therefore, the air-fuel ratio of the mixture is controlled immediately toward the rich side at the time of a down-shift operation of the transmission gear. Thus, the air-fuel ratio is prevented from becoming lean, and the driveablity during a transitional period toward a high load condition is improved. On the other hand, the air-fuel ratio is immediately controlled toward the lean side at the time of an up-shift operation. Thus, the air-fuel ratio is prevented from being enriched, and an improvement of the fuel economy is enabled without sacrificing the driveability during a transitional period in which the engine load is changing toward the light side.

What is claimed is:

1. An air-fuel ratio control system for an internal combustion engine mounted on a vehicle and having a transmission, comprising:

an oxygen concentration sensor disposed in the exhaust passage of the engine and producing an output signal whose level is substantially proportional to the oxygen concentration of the exhaust gas;

means for detecting the shift condition of said transmission; and feedback control means responsive to the output signal of said oxygen concentration sensor for feedback controlling the actual air-fuel ratio of the mixture to be supplied to the engine toward a target air-fuel ratio;

said air-fuel ratio control system further comprising target air-fuel ratio determining means for determining a target air-fuel ratio in accordance with predetermined parameters of engine operation, and for correcting said target air-fuel ratio in such manner that the higher the shift position of the transmission is, the leaner the corrected target air-fuel ratio becomes, the resultant value of the target air-fuel ratio as determined and corrected by said target air-fuel ratio determining means being used as the target air-fuel ratio in said feedback control means.

2. An air-fuel ratio control system as set forth in claim 1, wherein said internal combustion engine has a carburetor and an intake manifold, said feedback control means including an air intake side secondary air supply passage leading to the intake manifold on the down stream side of the carburetor, an open/close valve disposed in said air intake side secondary air supply passage, detection means responsive to the output signal of said oxygen concentration sensor for detecting whether the air-fuel ratio of the mixture to be supplied to said engine is leaner or richer than said target air-fuel ratio, and a valve drive control means for driving said open/close valve to control the ratio of opening and closing of said open/close valve in response to the result of said detection by said detection means.

3. An air-fuel ratio control system for an internal combustion engine having an air intake passage with a carburetor and an exhaust passage, and mounted on a vehicle with a transmission, comprising:

an air intake side secondary air supply passage leading to the air intake passage on the downstream side of the carburetor;

an open/close valve disposed in said air intake side secondary air supply passage;

an oxygen concentration sensor disposed in said exhaust passage and producing an output signal whose level is substantially proportional to the oxygen concentration of the exhaust gas;

base valve open period setting for setting a base valve open period in response to a plurality of engine parameters every cyclic period; detection means for detecting the shift condition of said transmission; detection means for detecting whether an air-fuel ratio of the mixture to be supplied to the engine is leaner or richer than the target air-fuel ratio from an output signal level of the oxygen concentration sensor; correction means for correcting said base valve open period at least according to said detected shift condition of said transmission and said detection of the state of richness of the air-fuel ratio of the mixture, to provide an output valve open period; and driving means for opening said open/close valve during said output valve open period within each of said cyclic periods.

* * * * *